US007380284B1

(12) United States Patent
Dodani

(10) Patent No.: US 7,380,284 B1
(45) Date of Patent: Jun. 3, 2008

(54) DEFORMABLE BIB AND METHOD FOR USING SAME

(76) Inventor: Kaneyo L. Dodani, 325 Colorado Pl., #3, Long Beach, CA (US) 90814

( * ) Notice: Subject to any disclaimer, the term of this patent is extended or adjusted under 35 U.S.C. 154(b) by 0 days.

(21) Appl. No.: 11/840,021

(22) Filed: Aug. 16, 2007

(51) Int. Cl.
*A41B 13/10* (2006.01)

(52) U.S. Cl. ..... 2/49.1; 2/49.2

(58) Field of Classification Search ..... 2/49.1, 2/49.2, 48, 49.3–49.5, 51, 52, 46, 50, 88, 2/60, 174, 207; 24/7–9
See application file for complete search history.

(56) References Cited

U.S. PATENT DOCUMENTS

| | | | | | |
|---|---|---|---|---|---|
| 590,991 | A * | 10/1897 | Lenhart | 2/49.2 |
| 615,293 | A * | 12/1898 | Maier | 2/49.2 |
| 677,010 | A * | 6/1901 | Ziller | 2/49.2 |
| 851,107 | A * | 4/1907 | Rink | 2/52 |
| 996,084 | A * | 6/1911 | Herring | 2/49.2 |
| 1,592,283 | A * | 7/1926 | McKenzie | 2/48 |
| 2,517,357 | A * | 8/1950 | Schlegel, Jr. | 2/49.2 |
| 2,532,932 | A * | 12/1950 | Neiswander | 2/49.2 |
| 3,010,111 | A * | 11/1961 | Ralph | 2/49.3 |
| 4,441,212 | A * | 4/1984 | Ahr et al. | 2/49.2 |
| 4,862,518 | A * | 9/1989 | Williams et al. | 2/49.1 |
| 5,956,763 | A * | 9/1999 | Blackshear | 2/49.1 |
| 6,079,048 | A * | 6/2000 | Campbell | 2/49.1 |
| 6,105,165 | A * | 8/2000 | Johnson et al. | 2/49.2 |
| 6,256,788 | B1 * | 7/2001 | Loewer et al. | 2/49.2 |
| 6,732,375 | B2 * | 5/2004 | Nornes | 2/49.1 |
| 2003/0074710 | A1 * | 4/2003 | Sanders et al. | 2/49.2 |

FOREIGN PATENT DOCUMENTS

| | | | |
|---|---|---|---|
| JP | 09003704 | A * | 1/1997 |
| JP | 2006214070 | A * | 8/2006 |

* cited by examiner

*Primary Examiner*—Amy B Vanatta
(74) *Attorney, Agent, or Firm*—Fulwider Patton LLP

(57) ABSTRACT

A disposable protective covering, namely, a bib or napkin of generally rectangular shape is disclosed consisting of two layers, a first layer of soft absorbent paper and a second layer made of water impermeable material, embossed or bonded together, having two pressure sensitive adhesive strips with protective liners on the corners of the upper portion of the second layer, a rapture (perforated) line for a neck line cut-out in the center of the upper portion and edge portions including wires (embedded between the first & second layer) attached parallel to the length of the bib at the lower portion to retain a manipulated shape of the bib.

8 Claims, 1 Drawing Sheet

DEFORMABLE BIB AND METHOD FOR USING SAME

BACKGROUND OF THE INVENTION

The present invention relates generally to barriers worn over clothing to protect same from spillage and staining, and more particularly to a dual layer disposable bib having a deformable perimeter for creating a tailored pouch or pocket to catch crumbs, food, and spilt beverages.

Protective barriers for clothing, or "bibs," are well known in the art. Such bibs can be non-disposable cloth bibs or disposable paper bibs intended for a single use. It is also known in the art to have a two ply disposable bib such as those used in dentists' offices and other oral hygienists. Most of these prior art bibs use a strap or band that encircles the neck and suspends the bib over the user's chest area. However, the prior art bibs lack the ability to customize a bib to a user's unique body characteristics and to manipulate the bib in a user's determined shape to form a pouch for capturing food and the like.

SUMMARY OF THE INVENTION

The object of this invention is to provide an improved disposable bib/napkin that is extremely flexible, multi-functional, simple to use, free of cumbersome strings, ties, snaps and other such attachments, and very low manufacturing cost. A dual layer barrier incorporates a first layer of absorbent material such as paper, and a second layer of more impermeable nature such as polyethylene or the like. On the rear surface of the second layer is a double-sided adhesive tape that can be used to secure the bib to a user's clothing without the use of ties, straps, or other entanglements in any position the user desires. This can be particularly useful if the clothing has an unusual contour, where the bib can be strategically located to accommodate the irregularities. Along the contour of the bib, preferably between the two layers or affixed to one of the layers is a rigid wire or band that can be deformed into any number of positions to allow the bib to take numerous shapes. In particular, the bib can be folded upwards at a lower portion to create a pouch or pocket to catch any food or drink that should fall off the bib. Because the bib is deformable, the pocket or pouch can be customized to the unique needs of the user, where both the size and dimensions of the pouch can be established by the user by selectively folding the edges upwardly.

The present invention can be used by a child or adult in any situation where there is a distinct possibility of staining either a user's garment or on any object that needs protection from spills of liquids, falling particles, etc. The application/uses are numerous; e.g., on airlines, cruises, fine restaurants, fast food chains, car & rail commuting, private residences, work places, outdoors, nurseries, schools, dental offices, hospitals convalescent homes, hair & make-up salons, and so on.

Other features and advantages of the invention will become apparent from the following detailed description, taken in conjunction with the accompanying drawings which illustrate, by way of example, the features of the invention

DETAILED DESCRIPTION OF THE PREFERRED EMBODIMENTS

Figures 1, 2, 3, 4, 5, 6:
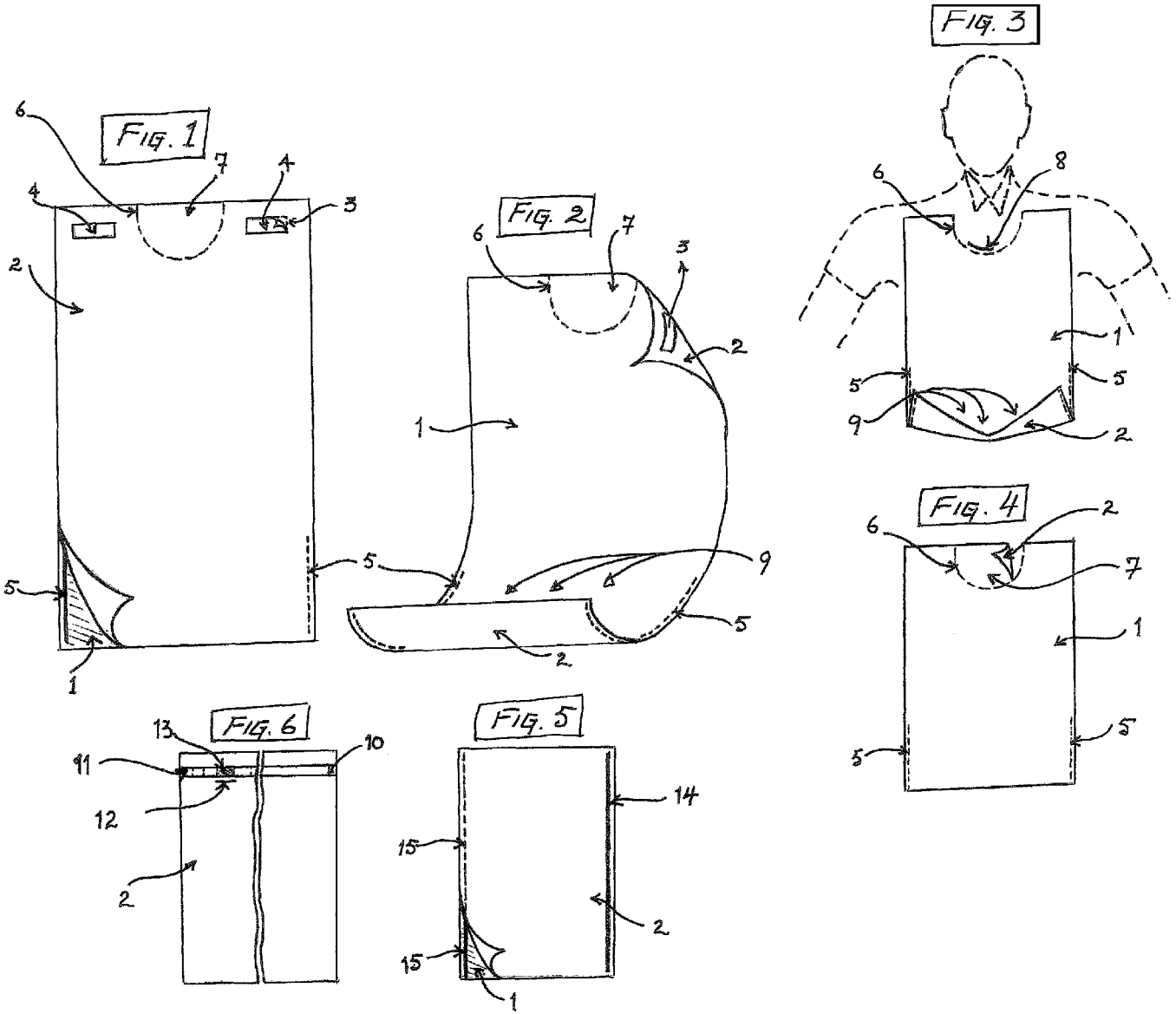
FIG. 1 is a plan view of the backside of the present invention.
FIG. 2 is an elevated perspective view of the front side of the present invention illustrating a pocket that may be formed by manipulating the wires at the lower portion of the invention.
FIG. 3 is a front view of the present invention in use with the neck cut-out piece removed from the perforation and illustrating a second example of a "pocket" formed by manipulation of the wire at the lower portion of the invention.
FIG. 4 is a front view illustrating removal of the neck cut-out piece.
FIG. 5 is a rear view illustrating a second embodiment of the invention.
FIG. 6 is a rear view illustrating a third embodiment of the present invention.

Reference is made to FIGS. 1-6 in the attached drawings. The present invention is characterized by a dual layer bib as shown generally in FIG. 1, comprising a double or triple ply cellulose sheet or suitable soft absorbent paper 1, in combination with a single ply, water-resistant polyethylene sheet or similar material 2. The dual layers can be bonded together, preferably at the periphery, so as to form a single bonded article having multiple layers. The double layers of the bin (cellulose sheet or suitable soft absorbent paper embossed/bonded to a polyethylene sheet or similar material that is water resistant) offers more than sufficient protection for a reasonable amount of liquid spills, falling particle, crumbs, etc. that a wearer, for example, might experience while dining.

The rear surface includes first and second adhesive strips 3 with peel-away protective liners 4 to allow the bib to be positioned on the user's clothing at a location selected by the user. It should be noted that the number, shape, and location of the adhesive strips 3 can vary according to the specific application without deviating from the scope of the present invention. The area of adhesion is sufficient to provide an adequate surface for adhesion to, for example, a wearer's clothing so that it will not tear loose from the bib or damage the user's clothing. The adhesive strip should have sufficient strength to ensure that the bib will not be dislodged due to slight pulls or reasonable body movement.

One preferred size of the bib is approximately 13×18 inches, and the rectangular adhesive strips are approximately one half an inch by one and one half inches. Sizes of the above described items can vary depending on it's intention for use on children, adults and any other object. Also, the sizes may vary to accommodate the full capability of the machinery utilized in the manufacturing process; cost effectiveness being it's primary objective. Similarly, all the raw materials utilized in creating this invention would be determined with the following factors in mind: safety, low production cost and damage control, specifically, the adhesive which comes in contact with a garment or object.

One first and second edges of the bib are wires or metal strips 5 (hereafter "wires") having the flexibility to bend into a desired shape, with a sufficient rigidity to hold the shape in place even against the gravitational force working to restore the bib to a planar shape. The wires may be secured to the polyethylene sheet as by adhesive or otherwise affixed to the perimeter of the bib in order to satisfy the shape selectable quality of the device. In a first preferred embodiment, the wires are comprises of ordinary "twist ties" found in grocery stores and in packages of plastic bags that embed a wire within a paper envelope to close bags of produce and the like. Alternately, a thin metal band or strip of aluminum or similar metal can be used. The bib preferably has the wires along a bottom edge in addition to the two side edges to give greater flexibility to the shapes that the bib can be formed and additional rigidity to maintain the shape in the selected configuration.

FIGS. 2 and 3 illustrate a perforated neck pull-out piece 7 that can be incorporated into the bib by perforating along a semi-circular direction as shown. However, the perforated neck cut-out 7 may be omitted as shown in FIGS. 5 & 6.

The method to utilize the bib would be three simple steps. First, the cut-out 7 at the center of the upper portion can be torn away at the perforation line 6 (as illustrated in FIG. 4) to form a neck line 8 (as illustrated in FIG. 3). Second, the protective liners 4 on the two pressure sensitive adhesive strips 3 are peeled off, exposing the adhesive that can be used to secure the bib to the user's garment. This is accomplished by gently pressing both of the exposed adhesive sides onto the user's garment (as illustrated in FIG. 3) or to any other object that needs to be protected from stains/particles. Then, the peripheral wires 5 are manipulated into any convenient shape desired by the user so that a reasonable quantity of spills/particles that dribble down the bib will be collected in the "pocket" 9 formed thereby. In this manner, user avoids any food or spillage from contacting either the shirt/blouse/jacket portion of the user's garment, and further prevents any spillage from collecting near the user's pants or clothing below the bib's lower end. Moreover, the paper layer 1 collects any grease or moisture that may be transferred from the food, whereas the protective polyethylene backing 2 resists any grease or moisture from seeping through the bib to the user's clothing. After use, the bib is easily detached from the garment and discarded. If necessary, the wires 5 can be bent into a cup-like configuration to hold/enclose the loose particles and/or spills for disposing of conveniently.

FIGS. 2 & 3 illustrate two examples of ways to manipulate the wires to form a pouch 9, although those of skill in the art will recognize that other configurations are possible.

It is further recognized that the two adhesive strips 3 may be replaced with one continuous adhesive strip with one continuous protective liner 10. The protective liner could also be perforated 11 in stages of approximately one inch in length 12 so as to enable the user to expose the adhesive strips 3 only in the desired sections 13.

As shown in FIG. 5, the wires 5 may be replaced by a permanently attached continuous wire 14 either directly on the bib or between 15 the cellulose sheet 1 and the polyethylene sheet 2 during the manufacturing process. The full length wires maybe coated with paper or plastic covering.

In light of the above teachings, it will be appreciated that several variations of the disclosed invention are possible. Keeping in mind that the novel features, characteristics and advantages of the invention have been set forth together with the structure and method of use, the above disclosures are merely illustrative; changes may be made in detail with respect to size, shape and structural arrangement. The principles of the invention should not be limited to the above described embodiment.

I claim:

1. A protective bib comprising:

a first layer of moisture absorbent material disposed on a front surface;

a second layer of water impermeable material disposed on a rear surface;

means for securing the first layer to the second layer at least at a periphery to define a space therebetween;

at least one adhesive member disposed on an outer surface of said second layer adjacent a top edge; and first and second elongate flexible members disposed along first and second lateral edges of said periphery of said bib, said flexible members having sufficient rigidity to retain an up-folded shape selected by a user.

2. The protective bib of claim 1 further comprising a third elongate flexible member disposed in said space along a bottom edge of said bib at said periphery and generally extending between said first and second lateral edges.

3. The protective bib of claim 1 wherein said first layer is made of paper.

4. The protective bib of claim 1 wherein said second layer is made of polyethylene.

5. The protective bib of claim 1 further comprising a perforated neck pull-out member along an upper portion of said bib.

6. The protective bib of claim 1 wherein said first and second elongate members are disposed in said space between said first and second layers.

7. The protective bib of claim 1 wherein said adhesive member comprises a plurality of segments of adhesive strips actuated by removing a protective backing.

8. A method for protecting a user's garments from spillage comprising the steps of:

providing a dual layer bib having a first layer of absorbent material and a second layer of water impermeable material, said bib further comprising flexible members disposed along first and second lateral edges where said flexible members have shape-retaining rigidity;

tearing said bib along a provided perforation line to release a neck pull-out section and expose a generally semi-circular void;

securing said dual layer bib such that said second layer is adjacent said garment by removing a protective backing from an adhesive member affixed to said second layer and applying said adhesive member to said garment in a position selected by said user;

bending first and second lateral edges of said bib at said flexible members to form an upwardly turned pouch; and discarding said bib.

* * * * *